United States Patent [19]

Yamagata

[11] 4,084,689

[45] Apr. 18, 1978

[54] PACKAGING ARTICLE

[75] Inventor: Ichiki Yamagata, Yao, Japan

[73] Assignee: Oji-Yuka Synthetic Paper Sales Co., Ltd., Japan

[21] Appl. No.: 741,515

[22] Filed: Nov. 12, 1976

[51] Int. Cl.[2] ..... B65D 85/18; B65D 33/02; B65D 33/14; B65D 33/20

[52] U.S. Cl. ..... 206/280; 150/7; 206/287; 229/55; 229/62

[58] Field of Search ..... 206/280, 286, 287, 45.34, 206/806, 260; 229/87 A, 55, 62, 80; 150/7

[56] References Cited

U.S. PATENT DOCUMENTS

| | | | |
|---|---|---|---|
| 1,065,450 | 6/1913 | Klein | 206/287 |
| 1,101,421 | 6/1914 | Falk | 206/287 |
| 2,056,804 | 10/1936 | Potdevin | 229/55 X |
| 3,026,016 | 3/1962 | Scher | 206/45.34 |
| 3,109,578 | 11/1963 | Davis | 229/62 |
| 3,149,771 | 9/1964 | Pearl | 229/55 |
| 3,625,414 | 12/1971 | Caiola | 229/62 |
| 3,827,625 | 8/1974 | Miller | 229/62 |

*Primary Examiner*—Stephen P. Garbe
*Attorney, Agent, or Firm*—Armstrong, Nikaido, Marmelstein & Kubovcik

[57] ABSTRACT

A packaging article using a thermoplastic film or sheet as a raw material therefor. The packaging article is provided with a bag opening in a region thereof. In forming the article, a front bag panel and a back bag panel are thermally fused together along their peripheral edges except the region defining the bag opening, into a bag form. The bag opening is associated with a flap for closing the same which is formed by extending either the front bag panel or the back bag panel and which has a reinforcing body thermally fused thereto. The reinforcing body is in the form of a laminate consisting of paper or synthetic paper having a thermoplastic layer applied thereto by lamination or by extrusion coating, which thermoplastic layer is thermally fused to the flap simultaneously with thermal fusion of the front and back bag panels. The reinforcing body is provided with an adhesive strip having a length extending throughout the width of the bag opening and a width such that when the flap provided with the reinforcing body is turned in, the adhesive strip is capable of joining the front and back bag panels to seal the entire bag opening. The reinforcing body assists in displaying the packaging article and it extends along the front or back bag panel to maintain or secure the configurational stability of the packaging article.

4 Claims, 6 Drawing Figures

11
2
10
15
6
14
13
7
5
1
2
4
4
2

10
11
6
14
7
8
9
9
5
12
3
2
1

PACKAGING ARTICLE

BACKGROUND OF THE INVENTION

The present invention relates to a packaging article using a thermoplastic film or sheet therefor for packaging various goods, such as underwear, babies' articles, and stationery, and more particularly it relates to a packaging article provided with a bag opening in a region thereof and a flap for closing said bag opening, said packaging article being adapted to display goods at stores, with the bag opening closed by said flap.

Packaging articles adapted for display, suspended in a showcase or the like with various goods, especially socks, stockings underwear and other textile products and ornamental accessories and cosmetics, put therein, are well known.

Since this type of packaging articles use a thermoplastic film or sheet or cellophane as a raw material therefor, if suspended with goods put therein, they would tear under the weight of the goods particularly in the region of the bag body where the suspender is attached. Therefore, it is usual with them to have a separate paper or other stiff strip serving as a suspender-attaching piece attached thereto as by a stapler. Such approach is troublesome in attaching the stiff strip and detracts from the external appearance in that staples or sawing thread stitches are exposed. Further, in order to facilitate the packaging of easily deformable goods, such as underwear, some packaging articles have a stiffener pasted to the front or back of the bag to increase the stiffness of the bag, said stiffener being extended to serve also as a suspender-attaching piece. However, the operation of folding the end edge of the front or back bag panel over the stiffener for pasting is troublesome and expensive. Further, when goods are put in such packaging article, even if the bag opening is closed by the flap, unless the bag opening is completely sealed there is the danger of dust entering through the bag opening to spoil the goods or sometimes contamination with formalin takes place.

SUMMARY OF THE INVENTION

The present invention has for its object the provision of a packaging article using a thermoplastic film or sheet as a raw material therefor and comprising a front bag panel and a back bag panel which are thermally fused together, a bag opening and a flap for closing said bag opening, said packaging article being characterized in that said flap is provided with a reinforcing body in the form of a thermally fusable laminate, eliminating a phenomenon of tear which can otherwise occur when the packaging article is suspended, the attachment of said reinforcing body being effected simultaneously with the thermal fusion step in the bag making operation.

Another object of the invention is to provide a packaging article highly convenient for packaging easily deformable goods wherein a reinforcing body in the form of a laminate is extended to be thermally fused to one or both of the front and back bag panels.

A further object of the invention is to provide a packaging article arranged so that after goods are put therein the entire bag opening is completely sealed to protect the goods against spoilage and contamination.

These and other objects and merits of the invention will become more apparent from the following detailed description taken in connection with the accompanying drawing. It is to be expressly understood, however, that modifications and changes in the details of the construction fall within the scope of the appended claims. cl

BRIEF DESCRIPTION OF THE INVENTION

DETAILED DESCRIPTION OF THE INVENTION

Figure 1:
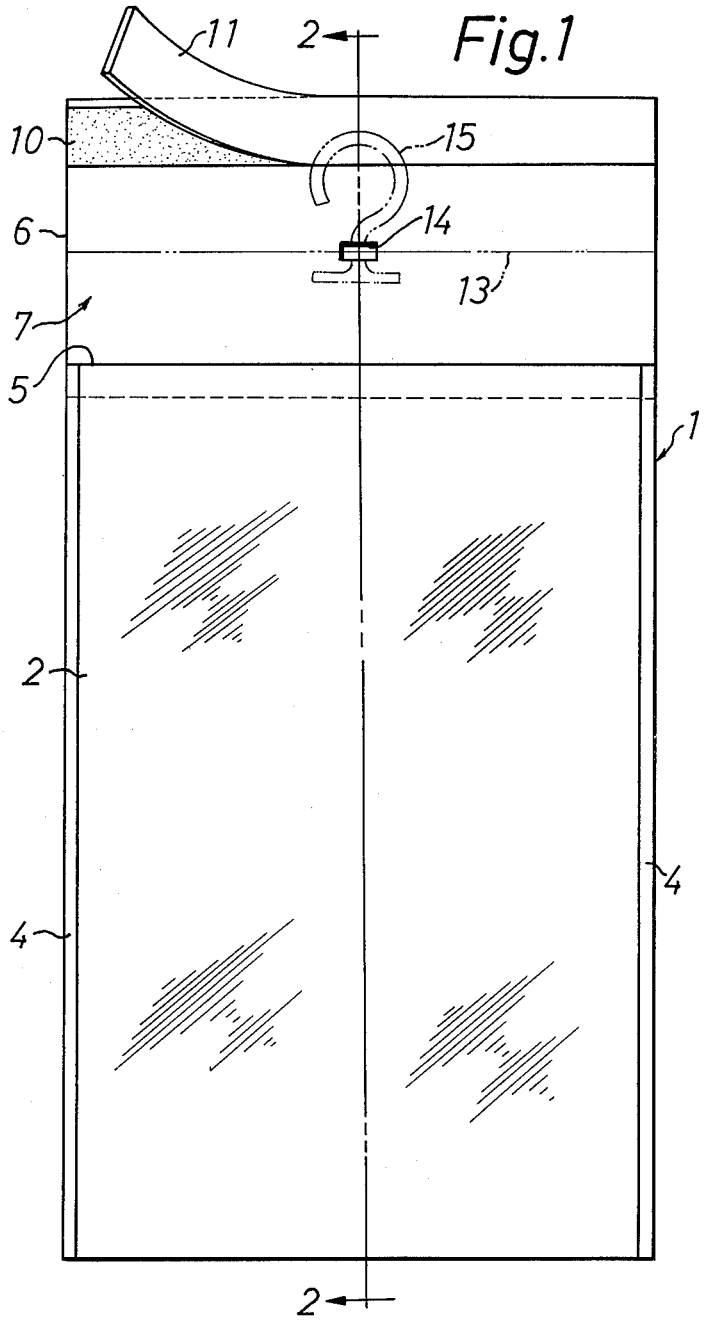
FIG. 1 is a front view of a packaging article according to the present invention.
Figure 2:
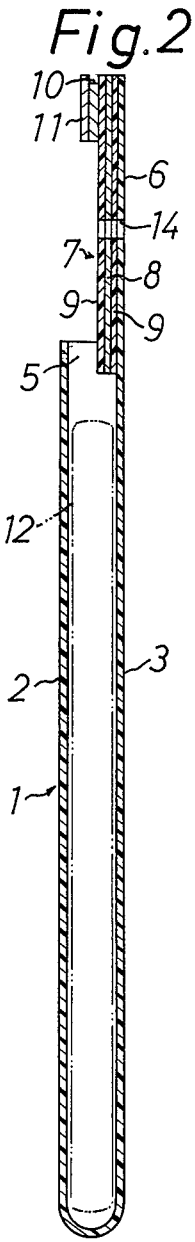
FIG. 2 is a side view in section taken along the line 2—2 of FIG. 1.
Figure 3:
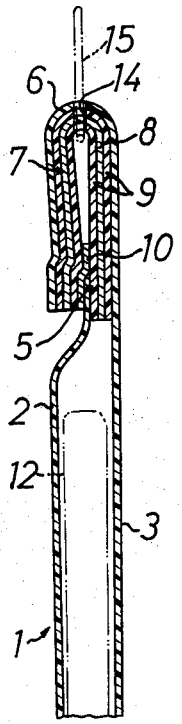
FIG. 3 is a sectional view showing how the bag opening is sealed after packaging of goods.

Referring to the drawing, particularly FIGS. 1 through 3, designated at 1 is a packaging article according to the present invention.

The packaging article 1, using as a raw material therefor a thermoplastic film or sheet of polyethylene, vinyl chloride, polypropylene or the like, comprises a front bag panel 2 and a back bag panel 3 which are thermally fused together along their opposite lateral edges 4, defining a bag opening 5 in the upper area thereof.

A flap 6 is formed by, for example, extending the back bag panel 3. The flap 6 has thermally fused thereto a reinforcing body 7 in the form of a laminate extending throughout the width thereof. The laminate consists of a strip of paper or synthetic paper 8 having thermoplastic layers 9 applied to the opposite surfaces thereof by lamination or by extrusion coating or by any other suitable means. With the inner plastic layer 9 placed on the inner surface of the flap 6, the front and back bag panels 2 and 3 are thermally fused together along the opposite lateral edges 4 and hence simultaneously therewith the inner plastic layer 9 is also thermally fused to the flap 6 so that the reinforcing body 7 is made integral with the flap 6. In the upper half of the flap 6, there is provided an adhesive tape for sealing purposes extending throughout the width of the flap and having a release paper strip 11 applied thereto. The flap 6 is folded back along with the reinforcing body 7 after goods indicated at 12 are put in. In order to facilitate such folding back, it is advantageous to provide a folding line cut in the reinforcing body 7 as indicated at 13. In order to completely seal the bag opening 5 after the goods 12 are put in, the pressure-sensitive adhesive surface of the adhesive tape 10 has a sufficient width to join both the back bag panel 3 and the front bag panel 2, as shown in FIG. 3, and extends throughout the width of the bag opening 5. Located centrally of the folding line 13 is an attaching hole 14 which extends all the way through. The attaching hole 14 may be directly hooked by a suspender or receive a hanger 15 or the like whereby the packaging article 1 having goods 12 put therein can be suspended in a showcase or the like in the usual way.

Figure 4:
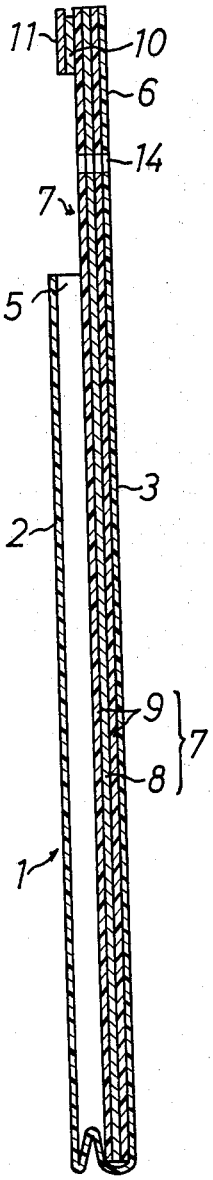
FIG. 4 is a side view, in section, showing a first modification of the packaging article.
Figure 5:
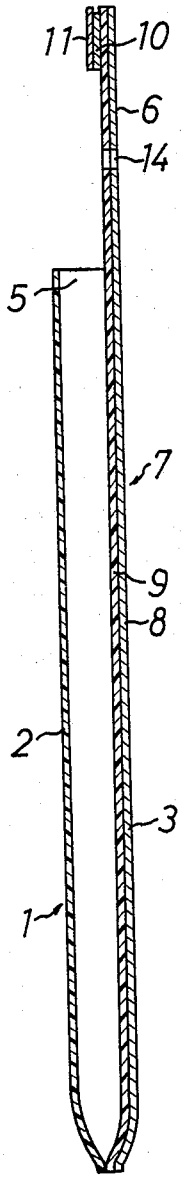
FIG. 5 is a side view, in section, showing a second modification.
Figure 6:
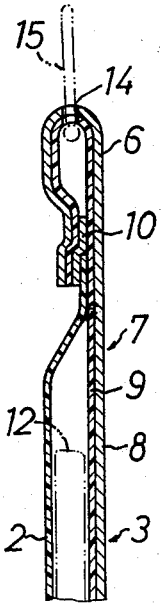
FIG. 6 is a sectional view showing how the bag opening in the packaging article in FIG. 5 is sealed.

Referring to FIG. 4, a reinforcing body 7 in the form of a laminate is extended over the entire inner surface of a back bag panel 3 and thermally fused to the latter along the opposite lateral edges thereof. In the case of FIG. 4, the bottom of the packaging article 1 has the so-called gusset construction providing a double bottom, as can be clearly seen in the figure. According to the arrangement of FIG. 4, the bag has increased stiffness facilitating the insertion of easily deformable goods such as underwear while the bottom of gusset construction enables the insertion of three-dimensional goods. In an embodiment shown in FIGS. 5 and 6, a reinforcing body in the form of a laminate, in itself, forms a back bag panel 3. In this case, a thermoplastic layer 9 is opposed to the back bag panel 3 for thermal fusion. While in FIGS. 1, 2, 3 and 4, the thermoplastic layers 9 have been shown applied to the opposite surfaces of the paper or synthetic paper 9 to form a laminate, in FIGS. 5 and 6 such thermoplastic layer 9 is applied only to that side which is opposed to the front bag panel 2. In the case of FIGS. 5 and 6, thermoplastic layers 9 may, of course, be applied to the opposite surfaces. The bag shown in FIGS. 5 and 6 has increased stiffness. In addition, in the case of the modifications shown in FIGS. 4 and 5, the front bag panel 2 is formed of a transparent plastic material to enable the goods contained in the bag to be seen through from the outside.

In order to improve the display effect, advantageously the front bag panel 2, back bag panel 3 or paper or synthetic paper 8 may be printed.

The term synthetic paper as used herein means a paper using thermoplastic synthetic resin as the principal ingredient with an inorganic material or pulp added thereto, the same being processed to have the so-called paper properties, including printability in various printing systems, writability and opacity.

Therefore, the reinforcing body 7 could be composed of synthetic paper alone, but the thermal fusion between it and the front bag panel 2 or back bag panel 3 or both would sometimes be insufficient. Thus, from the standpoint of securing a sufficient thermal fusion strength, it is desirable to prepare a reinforcing body 7 using a composite material (laminate) consisting of paper or synthetic paper 8 having a thermoplastic layer or layers 9 applied to one or both surfaces thereof by lamination or by extrusion coating.

When the packaging article 1 containing goods 12 therein is suspended for display, there is no possibility of the attaching hole 14 being torn under the weight of the goods 12. This is because the reinforcing body 7 attached to the flap 6 comprises paper or synthetic paper 8, which is sufficiently stiff, and thermoplastic layers 9, thus preventing, particulary by the action of the paper or synthetic paper 8, the tearing of the attaching hole 14 and hence the coming off of the hanger 15 or the like. Further, since the adhesive tape 10 on the flap 6 to be turned in along with the reinforcing body 7, which adhesive tape is intended to seal the upper edge of the bag opening 5 throughout the width thereof, has a sufficient width to overlap both the front bag panel 2 and the back bag panel 3, it is possible to prevent the entry of dust through the bag opening 5 and the contamination of the contents with poisonous gases.

On the other hand, the extended form of reinforcing body 7 for attachment to the bag increases the stiffness of the bag, facilitating the insertion of easily deformable goods and maintaining the configurational stability of the bag. Particularly, the use of reinforcing body 7 in the form of paper or synthetic paper 8 having thermoplastic layers 9 applied thereto by lamination or by coating or by any other suitable means allows the installation of the reinforcing body 7 to be performed by thermal fusion simultaneously with the step of thermal fusion between the front and back bag panels 2 and 3, thus dispensing with any separate fusion step for said reinforcing body and saving time and labor while providing a high bonding strength and greatly improving the external appearance of the bag.

I claim:

1. A packaging article formed from a thermoplastic sheet film and comprising a front bag panel and a back bag panel thermally fused together along their peripheral edges and defining a bag opening along one edge thereof, one of said front bag panel or said back bag panel being extended to form a flap on one side of said bag opening, said packaging article being characterized in that said flap has a reinforcing body affixed thereto said reinforcing body comprising paper or synthetic paper having a thermoplastic layer applied thereto, said reinforcing body being thermally fused to said flap by the thermal fusion of said thermoplastic resin layer simultaneously with thermal fusion between said front and back bag panels, and adhesive means provided on the edge of said flap said adhesive means extending throughout the width of said bag opening and said adhesive means having a sufficient width to seal the entire edge of said bag opening when it is turned in along with said flap to close said bag opening.

2. A packaging article as set forth in claim 1, wherein said reinforcing body is extended over the entire area of said front or back bag panel and thermally fused thereto, thus increasing the stiffness of the bag.

3. A packaging article as set forth in claim 1, wherein one of said front and back bag panels consists of a reinforcing body integral with the reinforcing body of said flap and wherein the other bag panel to be thermally fused thereto is formed of a transparent plastic film or sheet.

4. A packaging article as set forth in claim 1, wherein said reinforcing body includes an attaching hole in substantially the middle thereof which enables the packaging article containing goods therein to be suspended.

* * * * *

UNITED STATES PATENT AND TRADEMARK OFFICE

CERTIFICATE OF CORRECTION

PATENT NO. : 4,084,689

DATED : April 18, 1978

INVENTOR(S) : Ichiki Yamagata

It is certified that error appears in the above-identified patent and that said Letters Patent are hereby corrected as shown below:

On the cover page, section [73], one of the assignees, --Yamagata Gravure Co., Ltd.-- has been omitted. This assignee should be listed, in addition to the name of "Oji-Yuka Synthetic Paper Sales Co., Ltd." which presently appears on the patent.

Signed and Sealed this

*First* Day of *May 1979*

[SEAL]

*Attest:*

RUTH C. MASON
*Attesting Officer*

DONALD W. BANNER
*Commissioner of Patents and Trademarks*